United States Patent [19]

Goekler et al.

[11] Patent Number: 4,461,429

[45] Date of Patent: Jul. 24, 1984

[54] TAPE MACHINE SUPPORT

[75] Inventors: Robert G. Goekler, Owasso; Charles W. Hunt, Oologah, both of Okla.

[73] Assignee: Crutcher Resources Corporation, Houston, Tex.

[21] Appl. No.: 483,882

[22] Filed: Apr. 11, 1983

[51] Int. Cl.[3] ..... B65H 81/08

[52] U.S. Cl. ..... 242/7.22; 57/3; 57/10; 242/7.23

[58] Field of Search ..... 57/3, 6, 7, 10, 13–15; 242/7.01, 7.21, 7.22, 7.23

[56] References Cited

U.S. PATENT DOCUMENTS

| | | | |
|---|---|---|---|
| 1,852,827 | 4/1932 | Smith | 242/7.23 |
| 3,137,985 | 6/1964 | Bailey | 57/13 |
| 3,789,594 | 2/1974 | Rees | 242/7.22 X |
| 4,028,164 | 6/1977 | Montagut | 242/7.22 X |
| 4,358,064 | 11/1982 | Garneau | 242/7.23 |
| 4,426,834 | 1/1984 | Dokmo et al. | 57/3 X |

*Primary Examiner*—John Petrakes

*Attorney, Agent, or Firm*—Richards, Harris & Medlock

[57] ABSTRACT

An improved tape applying device (12) is provided. A number of tape roll support spindles (34) are pivotally mounted to a wrapping sprocket (14) which rotates about an axis (18). The spindles (34) support tape rolls (22). As the wrapping sprocket (14) rotates, the tape from these tape rolls are wrapped about a pipe (26). A rigid ring (66) is supported on a number of struts (50) spaced from and coaxial with the wrapping sprocket (14). A brace arm assembly (69) is secured between the ring (66) and selected spindles (34) to oppose centrifugal forces generated when the annular member rotates to apply the tape to the pipe.

6 Claims, 6 Drawing Figures

FIG. 1
PRIOR ART
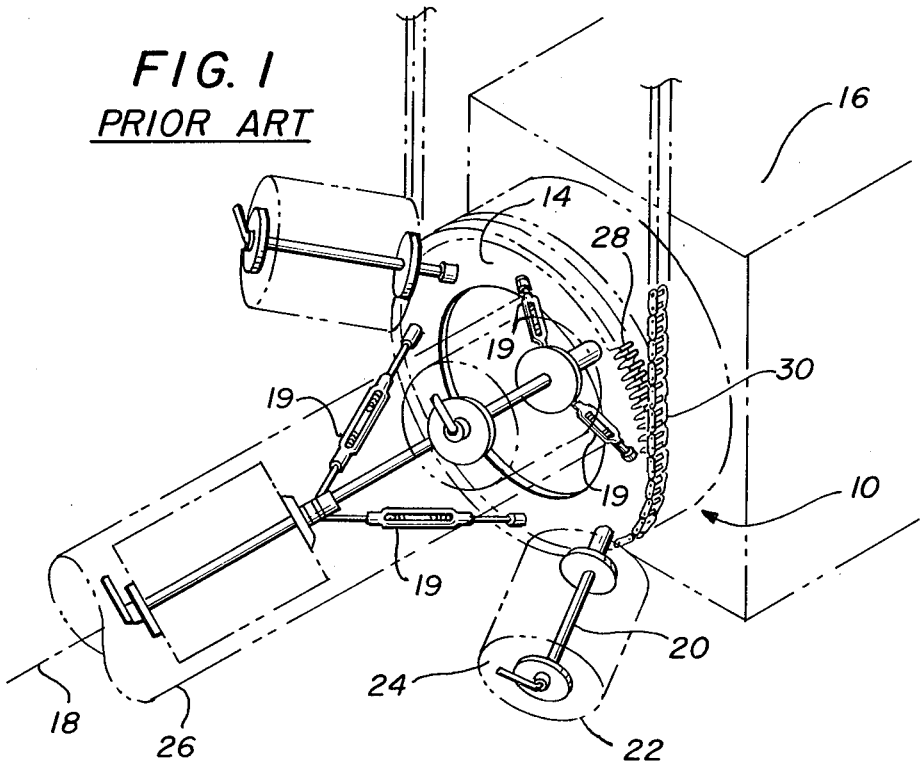
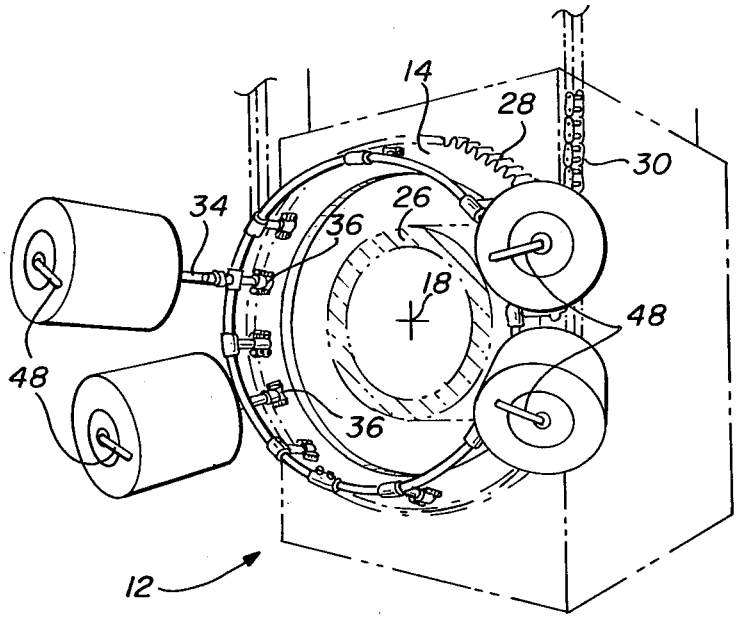
FIG. 2

TAPE MACHINE SUPPORT

TECHNICAL FIELD

This invention relates to equipment for treating pipe, and in particular equipment for applying layers of tape about the outer surface of the pipe.

BACKGROUND ART

In the pipeline industry today, it is common to wrap tape about pipe for protection. For example, an electrically insulating tape layer can insulate the pipeline from the ground. A relatively thick and resilient tape layer can act as a rock shield to reduce the opportunity for damage to the pipeline in service.

The desire to wrap the pipe with tape in a consistent and inexpensive manner has led to the development of a tape applying machine. This machine wraps tape around the outer surface of the pipe as the pipe is moved through the machine to apply the tape in a spiral manner. Several layers of the tape, or layers of different tape can be simultaneously applied by this machine.

In one particular machine for wrapping pipe, an annular member is rotated while the pipe passes therethrough. Tape roll supporting spindles are mounted on the annular member or wrapping sprocket which supports the tape roll. The spindle extends from the wrapping sprocket at a small angle from the axis of rotation of the wrapping sprocket. In a normal operation, the wrapping sprocket will rotate at 40 revolutions per minute (rpm) with each spindle holding a roll of tape which can weigh up to 165 pounds. Two, four, six or even eight rolls of tape can be supported on the wrapping sprocket by individual spindles mounted thereon.

As the wrapping sprocket rotates, centrifugal force is applied to the tape spindles. This force has been found to be sufficient to bend the spindles outwardly and cause misalignment of the tape wrapping. Therefore, a need exists to provide an apparatus to resist these forces and maintain the spindles and tape rolls in a fixed relationship relative to the pipe to allow consistent and uniform wrapping.

SUMMARY OF THE INVENTION

In accordance with one aspect of the present invention, a combination is provided for use in a machine for applying a tape to a pipe. The machine includes an annular member which is rotated about an axis with the pipe traveling through the annular member along the axis. At least one tape roll carrying spindle is mounted on the annular member to support a roll of tape for application to the pipe. The tape roll carrying spindle is mounted to the annular member at a predetermined radius from the axis. The combination includes a rigid ring having a smaller radius than the predetermined radius and a plurality of struts mounted on the annular member supporting the ring spaced from the annular member along the axis. The struts have a conical surface as their locus for supporting the ring from the annular member. A brace arm assembly is secured between the ring and the tape roll carrying spindle to provide support for the spindle and oppose centrifugal forces developed when the annular member is rotated to apply tape to the pipe.

In accordance with another aspect of the present invention, the combination includes a rigid ring having a radius smaller than the radius of the annular member and a plurality of struts mounted at a first end on the annular member and at a second end to the ring to support the ring spaced along the axis from the annular member and concentric with the axis. The first end of the strut is located at a greater radial distance from the axis than the second end. A brace arm assembly is mounted at a first end to the ring and at a second end to the spindle, the second end being located at a greater radial distance from the axis than the first end to support the spindle and oppose centrifugal forces generated when the annular member rotates to apply tape to a pipe.

BRIEF DESCRIPTION OF THE DRAWINGS

A more complete understanding of the invention and its advantages will be apparent from the following Detailed Description when taken in conjunction with the accompanying Drawings in which:

FIG. 1 is a perspective view of a prior art wrapping sprocket and tape roll carrying spindle supported directly from the wrapping sprocket;

FIG. 2 is a perspective view of a design incorporating the teachings of the present invention;

DETAILED DESCRIPTION

Figure 3:
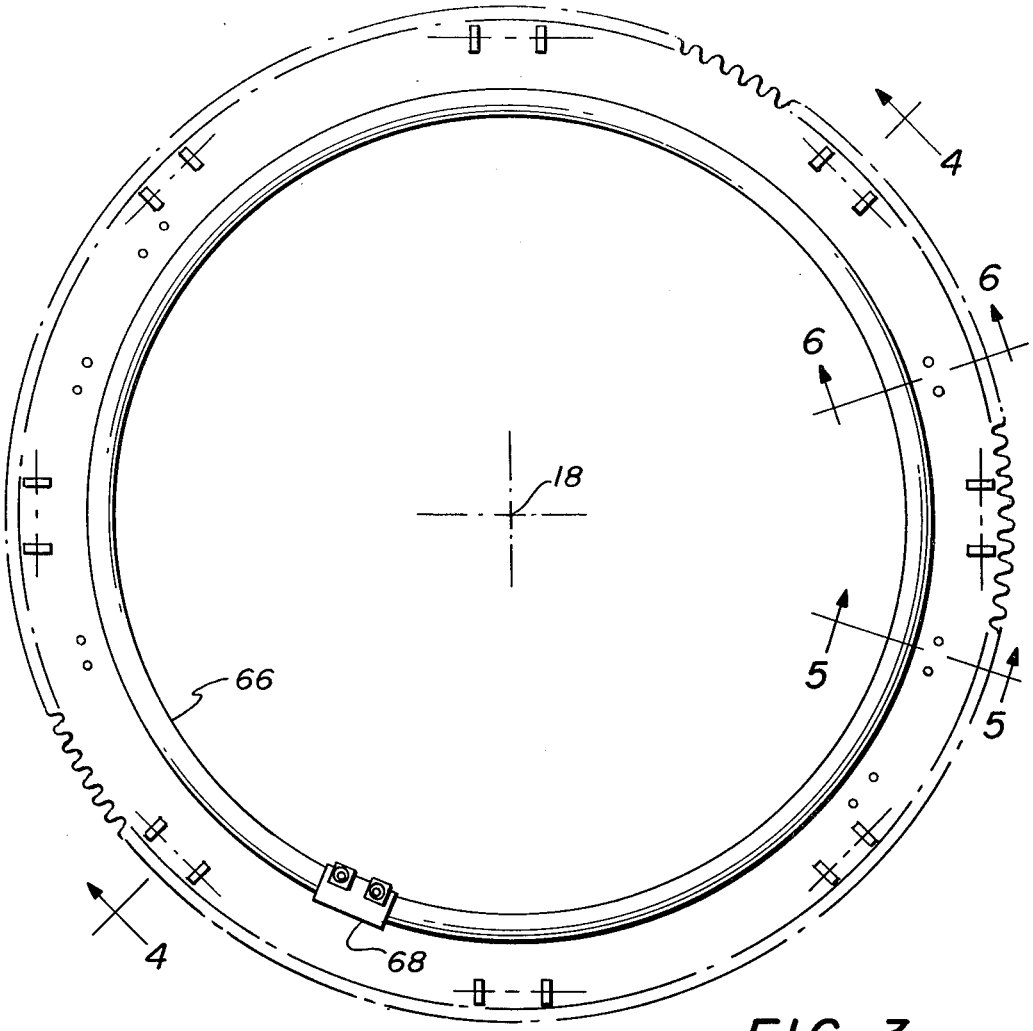
FIG. 3 is an end view of the wrapping sprocket which rotates and supports the tape roll carrying spindles.

Referring now to the drawings, wherein like reference numerals designate like or corresponding parts throughout several views, FIG. 1 illustrates a tape applying device 10 which is known in the art and FIGS. 2–6 illustrate a tape applying device 12 designed in accordance with the present invention.

The tape applying device 10 includes an annular member or wrapping sprocket 14 which is rotatably mounted on a machine 16 for rotation about an axis 18. Several tape roll support spindles 20 are mounted on the wrapping sprocket 14 and extend in a radially outward direction from the axis 18. Several of the spindles include turnbuckles 19 to provide lateral support thereto. The turnbuckles 19 are secured between the wrapping sprocket 14 and a spindle 20. The position where turnbuckles 19 are attached to annular member 14 lies generally on the same radius from axis 18 as is the point of attachment of spindle 20 to wrapping sprocket 14. The tape roll support spindles 20 each support a tape roll 22 having tape 24 for application to the pipe 26.

The wrapping sprocket 14 has an outer gear 28 which is meshed with a drive chain 30. A drive gear (not shown) rotates the wrapping sprocket 14 through the drive chain 30. The drive gear can be rotated by any conventional power source.

The machine 16 can coat the pipe 26 and then apply a layer of tape 24 on the outside thereof from rolls 22. The tape can be, for example, a polyethylene-butyl-rubber-adhesively backed tape that provides electrical insulation to the pipe, insulating it from the ground. One or more layers of this adhesive-backed tape can be applied. It is also common to apply a tape outside the adhesive-backed tape to serve as a mechanical or rock shield to protect the pipe from damage.

The wrapping sprocket 14 is commonly rotated at approximately 40 rpm. The tape rolls 22 commonly are as heavy as 165 pounds per roll. The centrifugal force acting on the tape and support spindles 20 during rotation causes misalignment of the tape wrapping as noted previously. The tape applying device 12 of the present invention illustrated in FIGS. 2–5 eliminates this problem and provides for uniform tape application independent of centrifugal forces.

Figure 5:
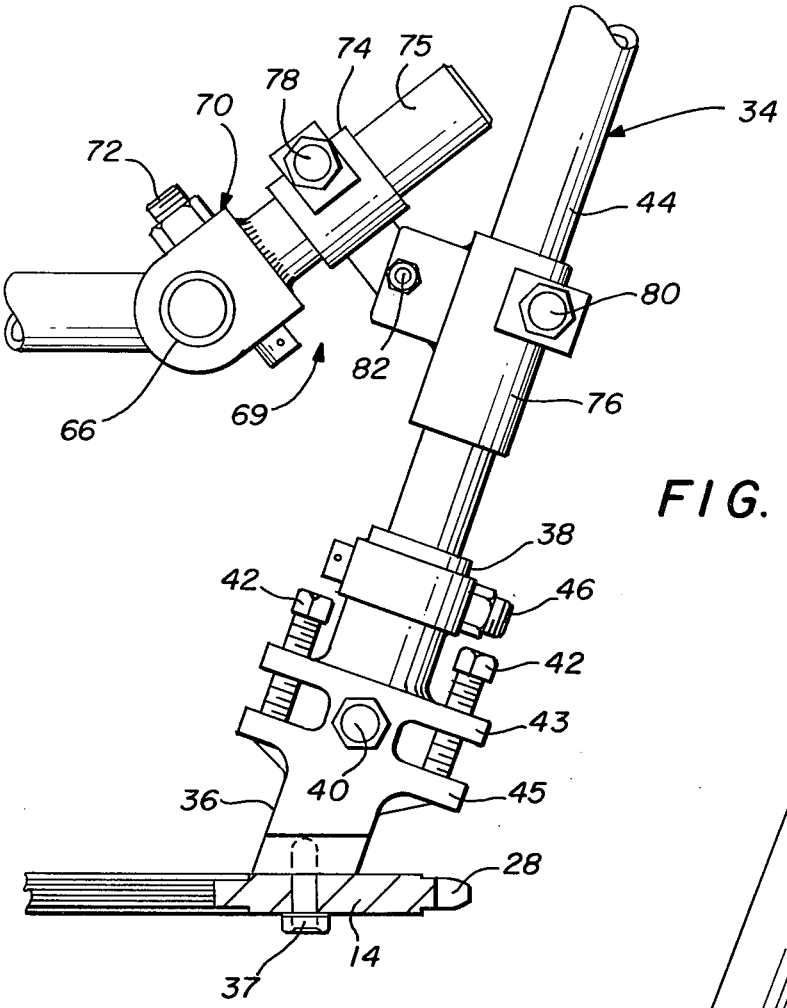
FIG. 5 is a cross-sectional view of the wrapping sprocket taken along line 5—5 in FIG. 3 in the direction of the arrows.
Figure 6:
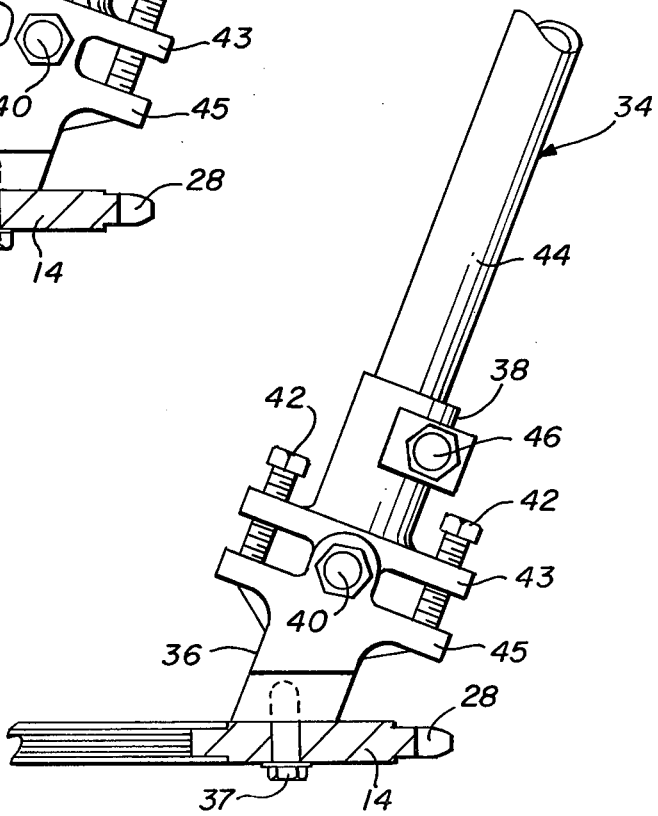
FIG. 6 is a cross-sectional view of the wrapping sprocket taken along line 6—6 in FIG. 3 in the direction of the arrows.

Several elements in the tape applying device 12 are identical to those in tape applying device 10, including the wrapping sprocket 14, gear ring 28, drive chain 30 and drive gear. However, tape roll support spindles 34 are mounted on the wrapping sprocket 14. Each spindle 34 includes a base 36 which is bolted directly to the wrapping sprocket 14 by bolts 37 as best seen in FIGS. 5 and 6. A socket 38 is pivoted to the base 36 through a bolt 40. Adjustment screws 42 are threaded through flanges 43 on the socket 38 and contact flanges 45 on the base 36. The screws 42 can be screwed in or out to pivot the socket 38 relative to the base 36. The socket 38 defines an opening for receiving a rod 44. A clamp assembly 46 secures the rod within the socket 38. The tape roll 22 can slide over the rod 44 and rotate freely thereon. A lever 48 at the end of rod 44 opposite socket 38 prevents the tape roll 22 from sliding off the rod 44. The pivot axis between the base 36 and socket 38 is preferably positioned so that the rod can be moved toward or away from the axis 18 in a plane containing the axis 18 which permits a variation in the overlap for each layer of tape applied.

Figure 4:
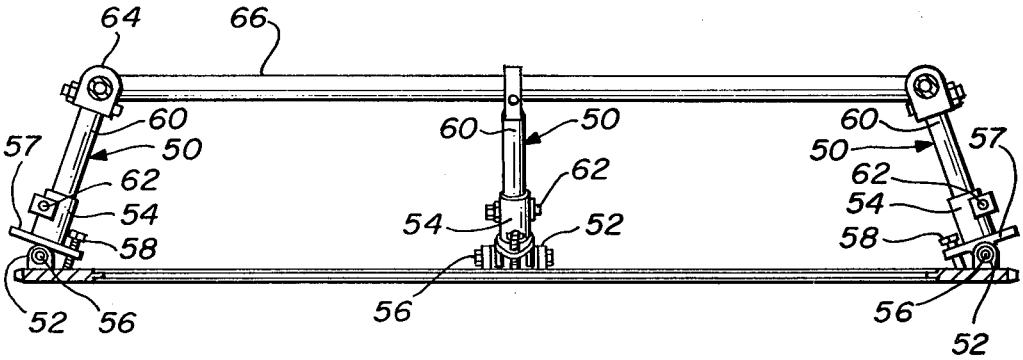
FIG. 4 is a partial cross-sectional view of the wrapping sprocket, rigid ring and support struts taken along line 4—4 in FIG. 3 in the direction of the arrows.

In addition to the tape roll support spindles 34, struts 50 are also secured to the annular member 14 as seen in FIG. 4. Each strut 50 includes a base 52 rigidly secured to the wrapping sprocket 14. A socket 54 is pivoted to the base 52 through bolt 56. The socket 54 includes a flange 57 with a threaded hole to receive a threaded bolt 58. The threaded bolt permits the angle of the socket 54 relative to axis 18 to be varied. A rod 60 fits within an aperture in the socket 54 and is secured therein by a clamp assembly 62. A ring clamp assembly 64 is secured at the end of rod 60 opposite the socket 54. Each strut 50 clamps onto a rigid circular ring 66 through ring clamp assembly 64 as best seen in FIG. 4. The ring 66 can be formed of a single length of rod bent into a circle with its free end secured by a clamp 68 as seen in FIG. 3.

The ring 66 supports a brace arm assembly 69, best seen in FIG. 5, which includes a brace arm 70 which can be clamped in a fixed relationship to the ring by tightening bolt 72. It is clear from FIG. 5 that the brace arm 70 can be oriented in any position desired relative to the ring 66 before tightening the bolt 72.

The brace arm 70 and rod 44 adjacent thereto are interconnected by the remaining pieces of brace arm assembly 69; a collar 74 and collar 76. The collar 74 slides over a portion 75 of the bracket 70 and can be secured thereon by tightening a bolt 78. The collar 76 slides over the rod 44 and can be tightened thereon by a bolt 80. The collars 74 and 76 are pivotally connected by a bolt 82.

It can be readily seen that the struts 50, ring 66 and brace arm assembly 69 provide a method for supporting the tape roll support spindles 34 against centrifugal forces generated by the rotation of the wrapping sprocket 14. The struts 50 extend radially toward the axis 18 from the wrapping sprocket 14 to the ring 66 to form a rigid mount for the ring 66. The adjustment bolts 58 can be adjusted to distribute the load on ring 66 uniformly to each strut 50 and support the ring concentric with axis 18. The struts 50 can be seen to lie on the surface of an imaginary conical surface having a locus on the axis 18. The pivotal connection between the collars 74 and 76 will permit the spindles 34 to be adjusted through adjustment screws 42 to a desired orientation relative to the axis 18. The various struts 50, ring 66 and brace assemblies 69 act together with the tape roll support spindles 34 to define a number of trusses having significant strength to maintain the spindle fixed during rotation.

The collars 74 and 76 are readily adjustable and movable from one spindle to another. For example, the spindle of FIG. 5 may need to be supported by the collars while the spindle of FIG. 6 does not. However, it would be a simple operation to mount a brace arm 70 on the ring 66 adjacent the spindle 34 of FIG. 6 and slide collars 74 and 76 onto the bracket 70 and spindle 34, respectively, to support the spindle in the same manner as the spindle of FIG. 5.

While one embodiment of the present invention has been described in detail herein and shown in the accompanying drawings, it will be evident that various further modifications or substitutions of parts and elements are possible without departing from the scope and spirit of the invention.

We claim:

1. In a machine for applying tape to a pipe wherein an annular member is rotated about an axis with the pipe travelling through the annular member along the axis and the annular member supports at least one tape roll carrying spindle to support a tape roll for application of the tape to the pipe, the spindle being secured on the annular member at a predetermined radius from the axis, the combination which comprises:

a rigid ring having a smaller radius than the predetermined radius;

a plurality of struts mounted at a first end on said annular member and mounted to said ring at a second end, said ring being spaced from the annular member along the axis, said plurality of struts extending along a conical surface having its locus on the axis; and a brace arm assembly secured between said ring and selected ones of said spindles to provide support for said selected ones of said spindles to oppose centrifugal forces created when the annular member rotates to apply tape to the pipe.

2. The combination of claim 1 wherein the tape roll carrying spindle is pivotally mounted on the annular member to adjust the position of the tape roll relative to the axis, said brace arm assembly being adjustable to permit the tape roll carrying spindle to be adjusted to a desired position.

3. The combination of claim 1 wherein said plurality of struts are each pivotally mounted on the annular member and adjustable about an axis perpendicular the axis of rotation of the annular member within a range of motion to distribute stresses uniformly in the struts.

4. In a machine for applying tape to a pipe wherein an annular member is rotated about a first axis with the pipe travelling through the annular member along the first axis, at least one tape roll carrying spindle for carrying a tape roll being pivotally mounted on the annular member at a first radius from the first axis, the spindle being pivotable in a plane containing the first axis, the combination which comprises:

a rigid ring having a radius smaller than the first radius;

a plurality of struts for supporting said ring on the annular member, the ring being supported concentric with and spaced from the annular member, each of said plurality of struts being secured to the annular member at a radius from the first axis greater than the radius of said rigid ring; and a brace arm assembly secured between said rigid ring and selected ones of the spindles to provide support to, said selected ones of the spindles and oppose centrifugal forces created when the annular member rotates to apply tape to the pipe from the tape roll supported on the spindle, said brace arm assembly including a brace arm having a rod portion thereon, said brace arm being secured to the ring, and first and second collars pivotally interconnected, the first collar being positioned along the rod portion of the brace arm and secured thereto and the second collar being positioned along the tape roll carrying spindle and secured thereto to permit pivotal adjustment of the tape roll carrying spindle.

5. The combination of claim 4 further including means for adjusting said struts to equally distribute the forces applied through the struts to the annular member during rotation of the annular member.

6. In a machine for applying tape to a pipe wherein an annular member is rotated about a first axis with the pipe travelling through the annular member and along the first axis, at least one tape roll carrying spindle for carrying a tape roll being pivotally mounted on the annular member at a first radius from the first axis, the tape roll carrying spindle being pivotal in a plane containing the first axis, the combination which comprises:

a rigid ring having a radius less than the first radius;

a plurality of struts supporting said rigid ring in spaced coaxial relation to the annular member, said plurality of struts extending from the annular member toward the first axis, each of said struts including a base secured to the annular member at a radius from the first axis greater than the radius of said rigid ring, a rod secured to said rigid ring and pivotally mounted on the base for pivotal motion in a plane containing the first axis and means for limiting the motion of the rod toward the first axis; and a brace arm assembly secured between said ring and selected ones of said spindles to provide support for said selected ones of said spindles to oppose centrifugal forces generated when the annular member rotates to apply tape to the pipe from the tape roll supported on the spindles, said brace arm assembly including a brace arm mounted on said rigid ring for pivotal motion in a plane containing the first axis and having a rod portion thereon and first and second collars pivotally interconnected for pivotal motion in a plane including the first axis, the first collar being positionable along the rod portion of the brace arm and secured thereto and the second collar being positionable along the tape roll carrying spindle and secured thereon to permit pivotal adjustment of the tape roll carrying spindle.

* * * * *